United States Patent [19]

Iseya et al.

[11] 4,333,245

[45] Jun. 8, 1982

[54] HEAD SUPPORTING DEVICE FOR UNIVERSAL PARALLEL RULER

[75] Inventors: Shigeo Iseya, Tsurugashima; Giichi Utagawa, Tokyo, both of Japan

[73] Assignee: Asahi Seimitsu Kabushiki Kaisha, Tokyo, Japan

[21] Appl. No.: 198,646

[22] Filed: Oct. 20, 1980

[30] Foreign Application Priority Data

Nov. 6, 1979 [JP] Japan ..... 54/143668

[51] Int. Cl.[3] ..... B43L 13/02

[52] U.S. Cl. ..... 33/438

[58] Field of Search ..... 33/430, 438–442

[56] References Cited

U.S. PATENT DOCUMENTS 4,145,815 3/1979 Otten et al. ..... 33/430

FOREIGN PATENT DOCUMENTS 949993 2/1956 Fed. Rep. of Germany ..... 33/438

*Primary Examiner*—Charles E. Phillips

*Attorney, Agent, or Firm*—Birch, Stewart, Kolasch & Birch

[57] ABSTRACT

A head supporting device for a universal parallel ruler is disclosed. The head supporting device connects the operating head of the ruler, having the scales attached thereto, to the cursor of the ruler, which is movable along a longitudinal rail. When the operating head and the scales are in contact with the drawing board surface, and are forced in an upward direction, the mechanism in the head supporting device locks the operating head in a raised position above the drawing board surface. The drawing may then be removed from the drawing board surface, or the surface may be cleaned. In order to unlock the mechanism in the head supporting device, a slight external downward force should be exerted onto the top of the operating head. Once the downward force exceeds a certain amount, the operating head, with the scales attached thereto, snaps back into contact with the drawing board surface. The essential parts of the mechanism include a tiltable holding member, pivotable about a central axis, biased by a spring or other means against a rolling member. The tilted position of the holding member coupled with the shape of two surfaces of the holding member maintain the operating head in either a raised or lowered position relative to the drawing board surface.

5 Claims, 8 Drawing Figures

HEAD SUPPORTING DEVICE FOR UNIVERSAL PARALLEL RULER

BACKGROUND OF THE INVENTION

1. Field of the Invention

The present invention relates to a head supporting device for a universal parallel ruler of the truck type.

2. Description of the Prior Art

In universal parallel rulers, a cursor is movably mounted on a longitudinal rail and is coupled to an operating head, having a scale, in such a manner that they can move toward and away from the drawing board surface, and the underside of the scale can be moved toward and away from the drawing board surface by moving the operating head toward and away from the drawing board surface, respectively. It has already been well known to cancel a weight of the operating head itself by normally spring-biasing the operating head to be lifted so that the head and the scale may be smoothly operated. With such a device of prior art, however, the spring force normally biasing the head to be lifted is set too high. The underside of the operating head and, therefore, the underside of the scale are disadvantageously prevented from being kept in close contact with the drawing board surface. This problem cannot be overcome even when the spring force normally biasing the head to be lifted is set to be low. On the contrary, the underside of the operating head and the scale is kept in close contact with the drawing board surface, since the load of the operating head and the scale in a direction toward and away from the drawing board surface largely depends upon the angle of the drawing board surface relative to the horizontal. For example, when the spring force is set with respect to a drawing board surface, which is horizontal, the load of the operating head, in a direction toward and away from the drawing board surface, gradually decreases when lifting the head as the angle of the drawing board surface increases. On the other hand, when the spring force is set, with respect to a drawing board surface which is largely inclined, the head is too heavily loaded to be smoothly operated as the drawing board surface approaches its horizontal position. To overcome this disadvantage, an improvement has been proposed. There is provided a means for changing the spring force normally biasing the head to be lifted in opposite directions with respect to an intermediate position between the position at which the underside of the operating head bears against the drawing board surface and the position at which the head has been lifted to the possible uppermost level, so that the head may be lifted when the head is located higher than the intermediate boundary position and the head may be brought by its own weight in close contact with the drawing board surface when the head is located lower than said intermediate boundary position. Even with this improvement, the force acting to hold the head at the lifted position higher than the intermediate boundary position depends on the spring force and, in consequence, an attempt to increase the head holding force would often result in the spring force, which normally biases the head to be lifted, in the vicinity of the drawing board surface, exceeding the head's own weight. Furthermore, the situation wherein the underside of the head is brought by its own weight in close contact with the drawing board surface, against the spring force, involves the disadvantage that occurs with the previously mentioned device of prior art when the spring force normally biasing the head to be lifted is set to be low.

SUMMARY OF THE INVENTION

An object of the present invention is to overcome the above-mentioned disadvantages and to provide a head supporting device for universal parallel ruler which enables the operating head to be reliably held lifted away from the drawing board surface under the action of the spring force while enabling the same spring force to bring the head into close contact with the drawing board surface.

Another object of the present invention is to provide a head supporting member which makes the spring force adjustable and, if desired, moves the head providing the head holding force and the contacting force.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
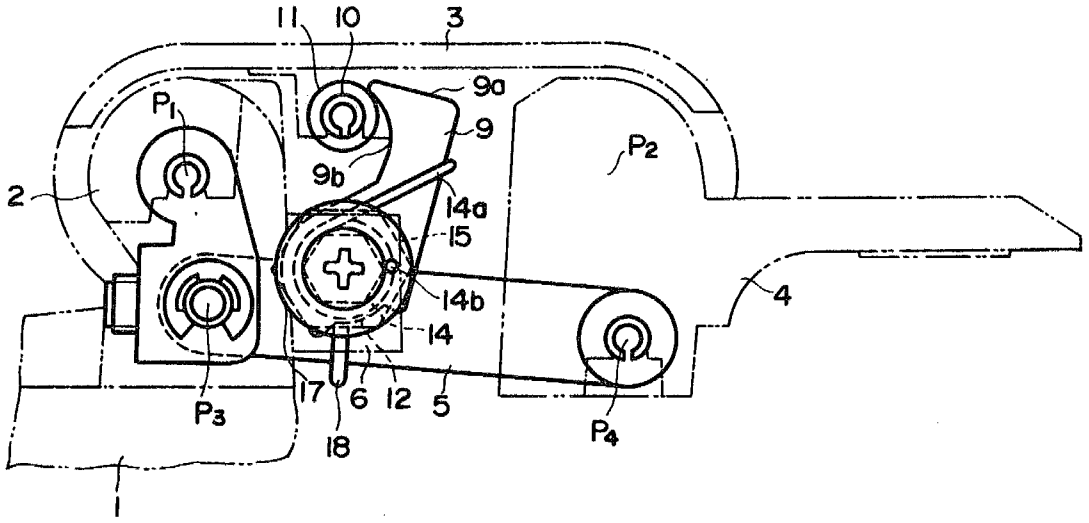
FIG. 1 is a front view showing an important portion in an embodiment of the device according to the present invention.
Figure 2:
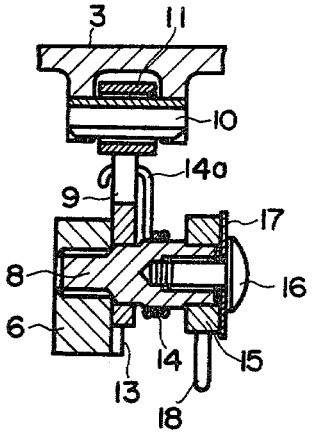
FIG. 2 is a side view showing a portion of said important portion partially in section.
Figure 3:
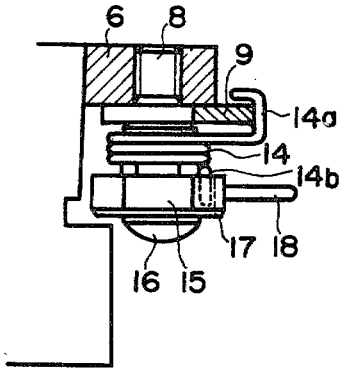
FIG. 3 is a plan view showing the same portion partially in section.

The present invention will be now described more in detail with reference to the preferred embodiments illustrated by the accompanying drawings. Reference numeral 1 designates a cursor movably guided along the underside of a longitudinal rail in a universal parallel ruler of the truck type. Reference numeral 2 designates a cursor side support integrally secured to said cursor 1. Reference numeral 3 designates a link member rotatably mounted at one end around a pivot on said cursor side support 2. Symbol $P_1$ indicates an axis of this pivot. Reference numeral 4 designates a head side support secured to a scale operating head in opposition to said cursor side support 2. This head side support 4 is rotatably mounted around another pivot in operative association with the other end of said link member 3. Symbol $P_2$ indicates an axis of this pivot. There is further provided another link member 5 of a cam member between the cursor side support 2 and the head side support 4 below the link member 3 in such a manner that the link member 5 is rotatably mounted around axes $P_3$, $P_4$ forming together with said axes $P_1$, $P_2$ a substantial parallelogram in operative association with the link member 3 and thereby the head side support 4 may be lifted, as being kept in its parallel posture, relative to the cursor side support 2 in the vicinity of the drawing board surface. It should be noted here that such a mechanism for parallel motion of the cursor side support 2 and the head side support 4 is well known. Accordingly, one of the most important features of the device according to the present invention lies rather in that the two supports 2, 4 are coupled to each other by a parallel motion mechanism including at least one link member 3.

Figure 4:
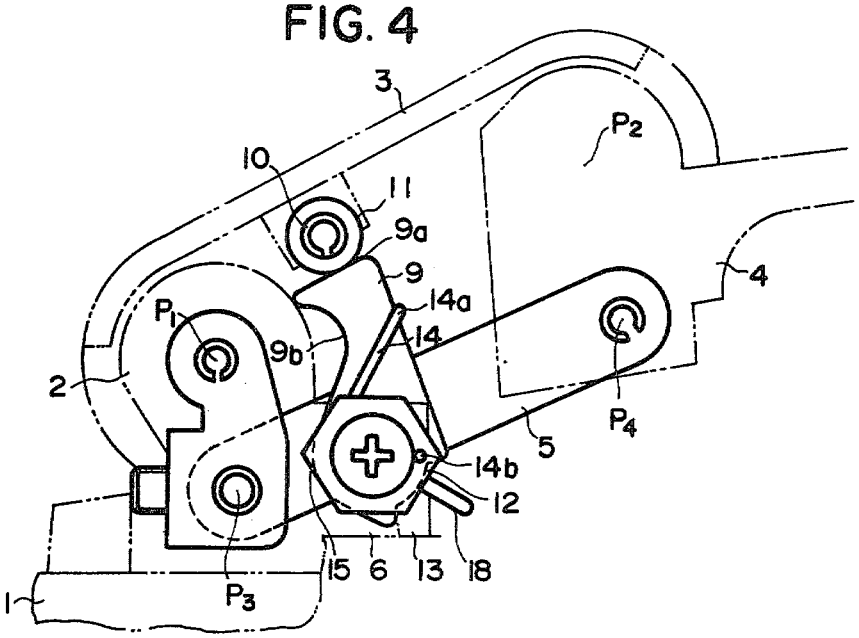
FIG. 4 is a schematic front view showing the important portion in the lifted position.

With the specific embodiment of the head supporting device according to the present invention of the particular arrangement as mentioned above, the cursor side support 2 is provided with a stationary supporting piece 6 which is, in turn, provided with a lifted condition holding member 9 adapted for rising and tilting around a pin 8 to hold the head lifted. In opposition to this, the link member 3 includes a rolling member 11 rotatably mounted around another pin 10 so that the stopper surface 9*a* of the holding member 9 bears against the rolling member 11 when said lifted condition holding member 9 rises, as seen in FIG. 4, and the stopper surface 9*a* tilts away from said rolling member 11 when the lifted condition holding member 9 tilts, as seen in FIG. 1. Upon engagement between the stopper surface 9*a* and the rolling member 11, a slight rotational moment is exerted on the lifted condition holding member 9, which is now in its raised position, in the direction of tilting around the pin 8 (clockwise as seen in FIG. 4). The slight rotational moment is preferably set so that the lifted condition holding member 9 cannot be tilted due to the load normally exerted on the head side support 4 from the head and the scale but can be tilted first when the operator exerts a depression on the head.

Reference numeral 12 designates a notch formed in the lifted condition holding member 9 around the pin 8. Within the notch 12, a stopper 13 mounted on the support piece 6 regulates the rising and tilting positions of the lifted condition holding member 9. Reference numeral 14 designates a spring member biasing the holding member 9 to be maintained in its raised position and serving also to bring the holding member 9 back to its tilting position. This spring member 14 is suspended around the pin 8 with one end 14*a* being engaged with the lifted condition holding member 9 and with the other end 14*b* being engaged with an adjusting member 15 which is, in turn, rotational position-adjustably mounted on the pin 8. In the embodiment shown, the adjusting member 15 is rotatably mounted on the pin 8 at its end so as to adjust the strength of the spring member 14 depending on the rotational position of said adjusting member 15 and can be integrally fastened to the pin 8 through a washer 17 by a clamping screw 16 threaded into an end surface of the pin 8. Although the adjusting member 15 has been shown and described as the one having hexagonal outer periphery in the form of the hexagon nut so that its rotation position adjustment may be achieved by use of a spanner, it will be also possible, of course, to mount a lever 18 or a handle integrally on the adjusting member 15 so that said lever 18 or said handle may be manually operated to achieve the desired position adjustment.

A surface 9*b* of the holding member 9 is adapted to abut against the rolling member 11 when said lifted condition holding member 9 takes its tilting position and is so inclined that the spring force exerts no lifting force on the rolling member 11 but urges the head and the scale to bear against the drawing board surface. As the adjusting member 15 is adjustably rotated by said lever 18 or the like continuously in the direction striving to reduce the spring force, at last a state will be reached, in which the lifted condition holding member 9 is maintained in its tilting position. This means that the present invention, as another important feature, can remove the effect of holding the head in a lifted condition, if desired.

With the head supporting device embodied according to the present invention as specifically constructed in the above-mentioned manner, the lifted condition holding member 9 takes its raised position shown in FIG. 4 under the biasing effect of the spring member 14 as the head side support 4 is moved upward from the position shown in FIG. 1 with the head held by the hand. The rolling member 11 then bears against the stopper surface 9*a* and is supported thereby as said head side support 4 is lowered. Now, even after the operator's hand has been released from the head, the head and the scale which are integral with the head side support 4 remain held in their lifted condition, since the lifted condition holding member 9 functions here as a stopper. In such a lifted condition, it is easily possible to perform scale displacement, drawing exchange and drawing board cleaning. Further downward force exerted on the head side support 4 with the head held by the hand results in an increased rotational moment exerted through the rolling member 11 upon the lifted condition holding member 9 in the direction of tilting thereof until the lifted condition holding member 9 rotates around the pin 8 against the force of the spring member 14 to its tilted position shown in FIG. 1 while the head side support 4 brings the head and the scale in close contact with the drawing board surface under the force of the spring member 14.

At the initial stage, in movement of the lifted condition holding member 9 from its raised position (FIG. 4) to its tilting position (FIG. 1), the rolling member 11 moves relative to the lifted condition holding member 9 along the stopper surface 9*a* of the lifted condition holding member 9 toward the abutting surface 9*b* and the spring member 14 acts to prevent the lifted condition holding member 9 from smoothly tilting. Therefore, such a force of the spring member 14 may be properly adjusted in order to set the force (which is striving to maintain the lifted condition holding member 9 in its rising position) to a desired level.

Once the rolling member 11 has abutted against the surface 9*b* of the lifted condition holding member 9, the spring member 14 now strives to urge the link member 14 downward and, therefore, such a force of the spring member 14 may be properly adjusted to set the force of the head and the scale toward a close contact with the drawing board surface to a desired level.

Figure 5:
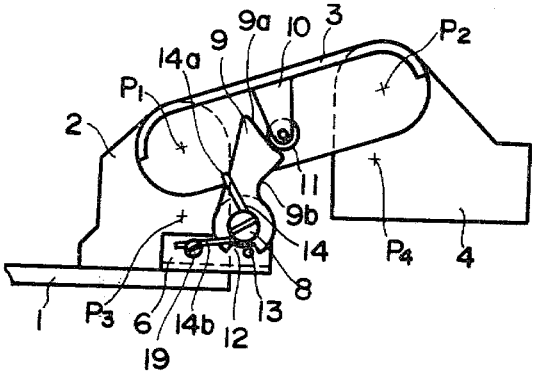
FIG. 5 is a front view of another embodiment of the present invention showing an important portion in the lifted position.
Figure 6:
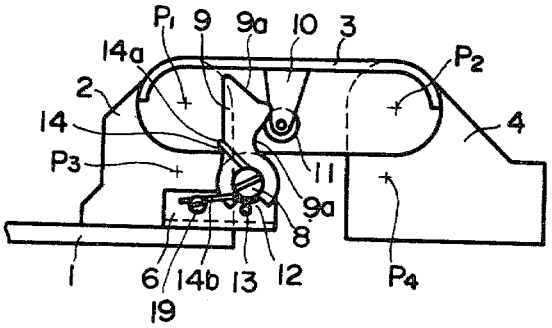
FIG. 6 is a schematic front view showing the important portion of FIG. 5 in close contact with the drawing board surface.
Figure 7:
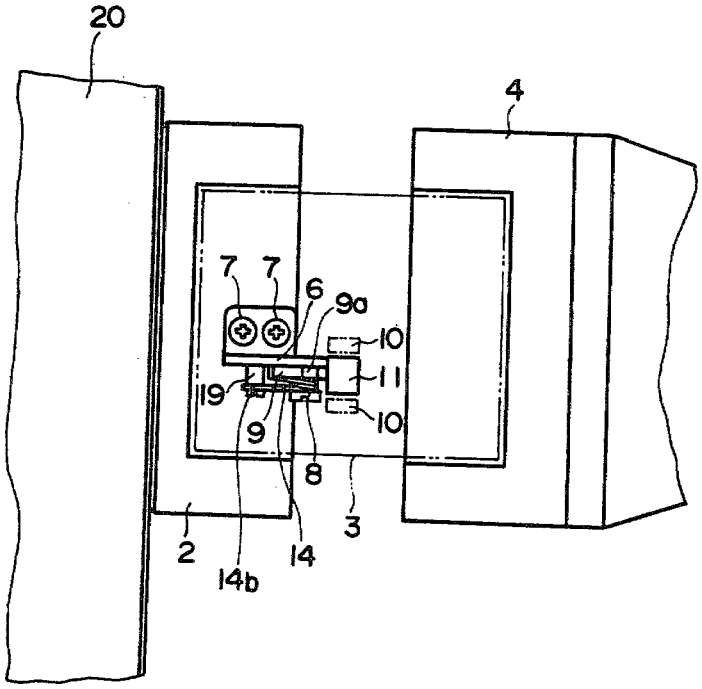
FIG. 7 is a schematic front view showing the important portion of FIG. 5.
Figure 8:
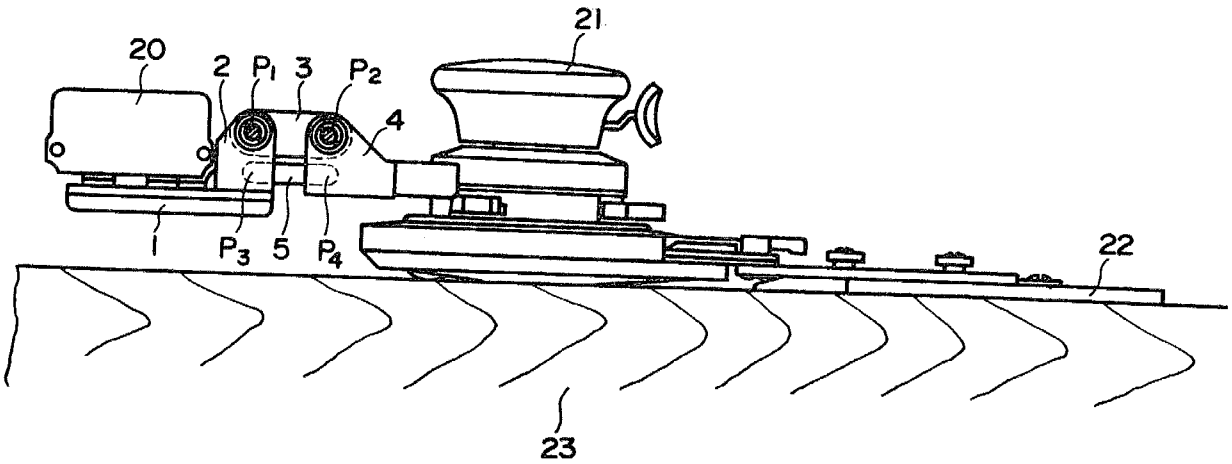
FIG. 8 is a schematic front view illustrating the manner in which the device of the present invention, as a whole, operates.

Another embodiment is illustrated by FIGS. 5 to 8 in which components being similar to those in the previous embodiment are designated by the corresponding reference numerals, respectively. In this embodiment, contrary to the previous embodiment, the lifted condition holding member 9 is biased by the spring member 14 to be rotated clockwise. When the head is in its lifted condition as shown by FIG. 5, the stepped stopper surface 9*a* of the lifted condition holding member 9 bears against the rolling member 11 at its left lower side and supports the rolling member 11 under action of the spring member 14 so that the link member 3, the head side support 4 and the head coupled to the latter are held in their lifted positions. When the head side support 4 is depressed toward the drawing board surface from the state as shown in FIG. 5, the lifted condition holding member 9 is counterclockwise tilted around the pin 8 against the force of the spring member 14 until the state of FIG. 6 is reached, in which the head is in close contact with the drawing board surface. In this position as shown by FIG. 6, the curved abutting surface 9*b* of the lifted condition holding member 9 abuts against the rolling member 11 at its left upper side so that the link member 3, the head side support 4 and the head coupled to the latter are urged by the force of the spring member 14 against the drawing board surface. Although, with this embodiment, the spring member 14 is engaged at the other end 14*b* with a pin 19 mounted on the supporting piece 6, it is possible, of course, that said other end 14*b* is engaged with the adjusting member 15 mounted on the pin 8. In this embodiment, the supporting piece 6 is secured by the screw means 7 directly to the cursor 1, as seen in FIG. 7. Referring to FIGS. 7 and 8, reference numeral 20 designates the longitudinal rail, reference numeral 21 designates the scale operating head, reference numeral 22 designates the scale and reference numeral 23 designates the drawing board.

It is also possible on the basis of the same principle that, on the contrary to the embodiment shown, the lifted condition holding member 9 is mounted on the link member 3 for rising and tilting and the rolling member 11 is mounted on the cursor side support 2.

With the head supporting device according to the present invention, as aforementioned, in a universal parallel ruler so arranged that the cursor side support is coupled to the head side support by a parallel motion mechanism including at least one link member, there is provided a lifted condition holding member tiltably mounted between said cursor side support and said link member so that said holding member may hold the link member lifted away from the drawing board surface when the holding member is in its raised position and there is provided a spring member to maintain the lifted condition holding member in the raised position with an adjustable force thereof, thus providing a simplified and reliable head supporting device in which the spring-biased member for the lifted condition holding member supports the head and the scale by its own rigidity instead of a higher supporting force of the conventional lead spring or a higher friction of the pivot while bringing the head and the scale in close contact with the drawing board surface under the action of the same spring member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A head supporting device for use with a universal parallel ruler attached to a drawing board, the parallel ruler including a cursor movably mounted along a longitudinal rail and coupled to an operating head having a scale attached thereto, the head supporting device being connected between the cursor and the operating head for permitting said operating head to move toward and away from the drawing board surface relative to the cursor, said head supporting device comprising:

lifted condition holding member means having a first surface and a second surface and being rotatably mounted along an axis substantially parallel to said rail for preventing a movement of the operating head away from the drawing board surface relative to the cursor when the universal parallel ruler is in a position nearest to the drawing board surface and an external force is not applied thereto and for retaining said operating head in a lifted condition when the universal ruler is in a position farthest from the drawing board and permitting a movement of the operating head toward the drawing board relative to the cursor when the universal parallel ruler is in a position farthest from the drawing board surface and an external force is applied thereto;

rolling member means rotatable about a central axis substantially parallel to said axis for engaging with said first surface of said holding member means when the universal parallel ruler is in said position nearest to the drawing board surface thereby preventing said movement of the head away from the drawing board surface and for engaging with said second surface of said holding member means when the parallel ruler is in said position farthest from the drawing board surface thereby retaining said head in a lifted condition and permitting said movement of the head toward the drawing board surface; and biasing means for exerting a force on said holding member means thereby forcing said lifted condition holding member means into contact with said rolling member means.

2. The head supporting device in accordance with claim 1 further comprising means for adjusting the force exerted by the biasing means on said lifted condition holding member means.

3. The head supporting device in accordance with claim 1 further comprising:

cursor side support means secured to said cursor;

head side support means secured to said operating head;

means for coupling said cursor side support means to said head side support means including, link member means pivotably mounted at opposite ends thereof to said cursor side support means and to said head side support means, respectively, and connected to said rolling member means for linking said cursor side support means to said head side support means when said rolling member means engages with the surfaces of said holding member means.

4. The head supporting device in accordance with claim 3, wherein said movement of said operating head away from the drawing board surface causes said head side support means to move away from the drawing board surface and causes the head side support means to pivot about one end of said link member means while said cursor side support means pivots about the opposite end of said link member means, said biasing means forcing said holding member means to engage with the rolling member means during rotation thereof, said operating head being maintained in a raised position away from the drawing board surface when said rolling member means engages with said second surface of said lifted condition holding member means.

5. The head supporting device in accordance with claim 4 further comprising means for adjusting the force exerted by the biasing means on said lifted condition holding member means.

* * * * *